United States Patent [19]

Crim et al.

[11] 4,222,132

[45] Sep. 16, 1980

[54] PATIENT TRANSPORT APPARATUS

[75] Inventors: Paul E. Crim, Portage; James W. Richmond, Comstock Township, Kalamazoo County; Thomas E. Yeomans, Portage, all of Mich.

[73] Assignee: Stryker Corporation, Kalamazoo, Mich.

[21] Appl. No.: 5,000

[22] Filed: Jan. 22, 1979

[51] Int. Cl.[2] ..... A47B 83/04; A61G 1/02

[52] U.S. Cl. ..... 5/81 R; 5/86; 5/81 C; 280/411 A

[58] Field of Search ..... 5/81 R, 81 B, 81 C, 5/86; 24/23 OR; 280/411 R, 411 A

[56] References Cited

U.S. PATENT DOCUMENTS

| | | | |
|---|---|---|---|
| 3,293,668 | 12/1966 | Auer | 5/81 R |
| 3,883,991 | 5/1975 | Adelhed | 5/81 R |
| 4,011,609 | 3/1977 | Bethlen | 5/81 B |

*Primary Examiner*—Casmir A. Nunberg

*Attorney, Agent, or Firm*—Blanchard, Flynn, Thiel, Boutell & Tanis

[57] ABSTRACT

An apparatus for transporting a patient from a zone having one level or type of contamination to a zone having a lesser level of such contamination, while minimizing the likelihood of contamination from the first zone being carried by the transport apparatus into the second zone. The apparatus includes a patient transport stretcher provided with means for locking it in end-to-end relationship with a wheeled surgical bed. The bed and stretcher are provided with rollers by which a patient-carrying litter may be easily moved from one to the other.

16 Claims, 6 Drawing Figures

PATIENT TRANSPORT APPARATUS

FIELD OF THE INVENTION

The invention relates to patient transport means, such as for hospital use, and relates particularly to means by which a patient may be transported from an area of relatively high contamination, such as the emergency reception room of a hospital, to an area of relatively low contamination, such as an operating room or other sterile zone, and whereby same may be accomplished with both a minimum of disturbance to the patient during such transport and with a minimum of contamination of the area of relatively low contamination by the transport and related means.

BACKGROUND OF THE INVENTION

In pursuance of continuing efforts to maintain a maximum level of cleanliness in various hospital facilities, such as operating and delivery rooms, means and procedures are constantly being developed to minimize the carrying of contaminating materials into these facilities. One particularly important possibility for such contamination lies in the means by which patients are transported from common areas of a hospital, such as reception rooms, X-ray laboratories, and corridors, into the sterile areas. It is desirable to transport said patients with a minimum disturbance, and yet undesirable to permit a transport means such as a stretcher or bed to carry contamination on its wheels or other components from the common area into the sterile area.

This problem has been previously recognized and some efforts made to solve it, however, these previous efforts have not been fully satisfactory. The present invention was developed to provide a more complete and satisfactory solution to this problem.

In particular, the patient in certain previous efforts, such as those illustrated by U.S. Pat. Nos. 3,883,991 and 4,011,609, is moved sidewise from one bed to another under conditions which require either manual lifting of the patient or manual lifting and sliding of a patient-carrying litter by personnel acting at each end of the respective beds. This is time consuming and requires two or more persons to accomplish this effectively. Said U.S. Pat. No. 4,011,609 also illustrates means for connecting two carriers in a side-by-side relationship, wherein the carriers are first aligned manually, and then each of several interlocking devices is individually and manually engaged, and later disengaged. This is likewise time consuming.

Other means, such as that illustrated by U.S. Pat. No. 3,293,668, have been developed for transporting a patient from one carrier to another on a single litter by means of rollers on both devices, but in this case the carriers are merely butted against a barrier and held thereagainst while the patient support means is moved. This requires personnel to hold the carriers against the barrier while other personnel move the patient support means.

In a continuing effort to improve such apparatus and overcome the above disadvantages, the device of this invention has now been developed wherein the carriers are provided with self-aligning end-to-end interlock means to ensure a secure interconnection while the patient is moved from one carrier to the other. The interlock means engages automatically when the carriers are pushed together in an end-to-end relationship, and is quickly and easily disengaged by a single release operation at any of several remote locations on the carrier. The interlock means is self-contained, requires no obstructing floor devices, and permits the entire patient transfer operation to be performed efficiently by a single person, with minimal discomfort to the patient.

Accordingly, the objects of the invention include:

1. To provide transport means for transporting an inert patient from a zone of high contamination to a zone of low contamination, with minimal disturbance to the patient, and minimal carrying of contaminating material from the first zone to the second zone, said transport means utilizing two wheel-supported patient carriers and having means to convey the patient therebetween.

2. To provide transport means, as aforesaid, including self-contained interlock means which is self-engaging, and securely interconnects the two carriers in an end-to-end relationship to provide a safe and efficient transfer of the patient therebetween.

3. To provide transport means, as aforesaid, which involves minimal structural change from presently known equipment such that additional manufacturing expense is minimized, operates in a manner obvious to hospital personnel upon inspection or after minimal instruction, is fully compatible with present hospital techniques and equipment, and does not interfere with the general functional use of either of said carriers.

Other objects and purposes of the invention will be apparent to persons acquainted with equipment of this general type upon reading the following specification and inspecting the accompanying drawings.

SUMMARY OF THE INVENTION

Figure 1:
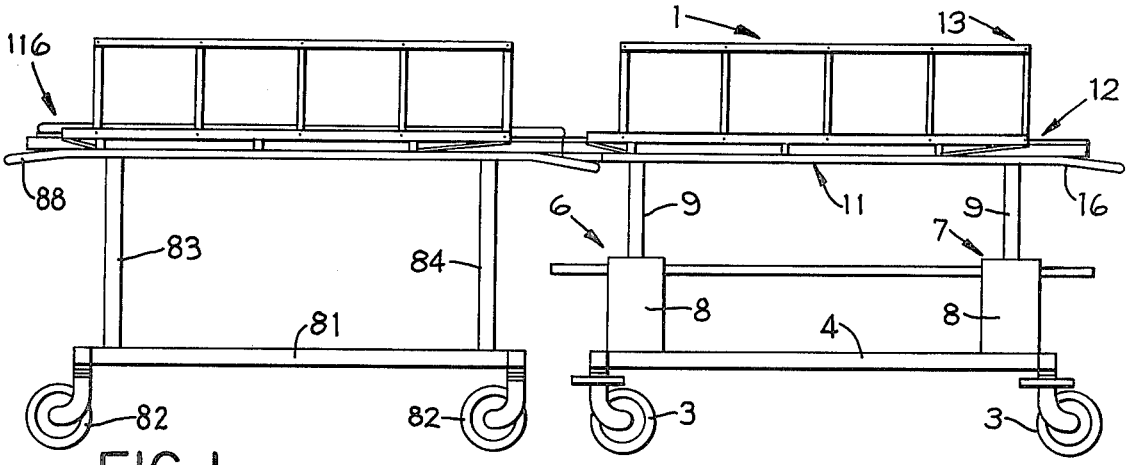
FIG. 1 shows somewhat schematically a patient transport stretcher and a movable surgical bed in end-to-end connected relationship according to the present invention.

According to the present invention, otherwise conventional wheel-supported patient carrying means, such as an otherwise conventional wheel-supported stretcher and wheel-supported surgical bed, are modified in part at their respective ends to permit rigid end-to-end interlocking thereof, with simple and efficient entry into and release from the interlocked condition. One patient carrier, such as the stretcher, has a guide device projecting from one end thereof for reception between side rail members of the other patient carrier, here the surgical bed, for aligning said carriers and holding them rigidly against lateral movement with respect to each other. Further, one of such carriers, here the stretcher, also has a self-actuating latch mechanism for engaging a suitable portion of the other carrier, here the surgical bed, for holding said carriers rigidly against longitudinal movement with respect to each other. Remote release mechanisms are provided for said latch mechanism. Both of said carriers are further modified in having roller support means and guide rails so that a patient-supporting litter may, with minimum disturbance to the patient, be moved by a single operator from one carrier onto the other.

DETAILED DESCRIPTION

Referring to the drawings, it will be recognized that many of the elements illustrated therein are of known construction and are set forth in detail solely for illustrating one specific embodiment. Insofar as possible, such portions are described only in broad terms and reference is made either to patents or to presently known devices for the details thereof. Likewise it will be recognized that certain of these components may vary widely within the scope of the present invention, and the present selection of certain ones thereof is solely for illustrative purposes and should not be construed as limiting.

Referring first to the first carrier, here the wheel-supported stretcher 1 in FIG. 1, this may, except for modifications hereinafter discussed, be generally similar to that illustrated in U.S. Pat. No. 3,304,116, which stretcher is manufactured and sold under the registered trademark "INSTACARE" by the Stryker Corporation of Kalamazoo, Michigan.

The stretcher 1 comprises a base structure 4 supported on four swivel casters 3. The base structure supports a pair of lift means 6 and 7, each of which may conveniently comprise a hydraulic cylinder 8 and a piston 9. Said pistons support a vertically adjustable table 11 which comprises a litter supporting frame 12 and side barriers 13. The side barriers are preferably collapsible in a known manner to permit convenient loading or unloading of the patient and/or ready access to a patient thereon. This basic structure is fully set forth in said U.S. Pat. No. 3,304,116.

Figure 3:
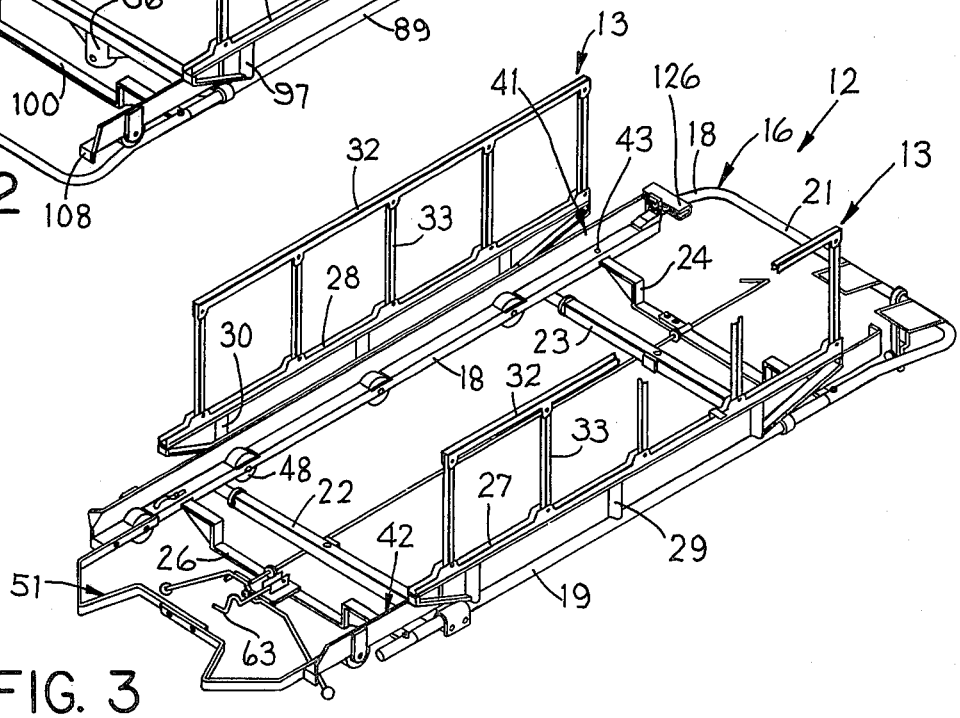
FIG. 3 is an oblique view of the litter supporting frame portion of a presently known wheel-supported surgical bed, modified to incorporate the concepts of the present invention.
Figure 4:
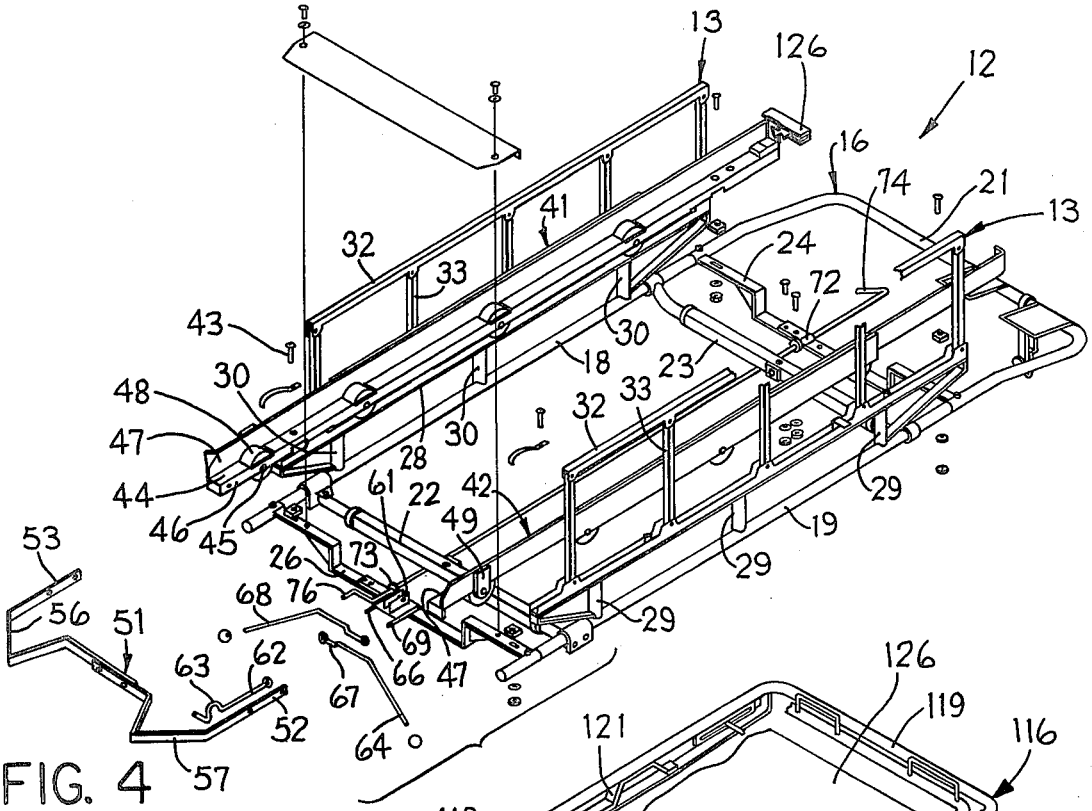
FIG. 4 is a partially exploded view of FIG. 3.
Figure 5:
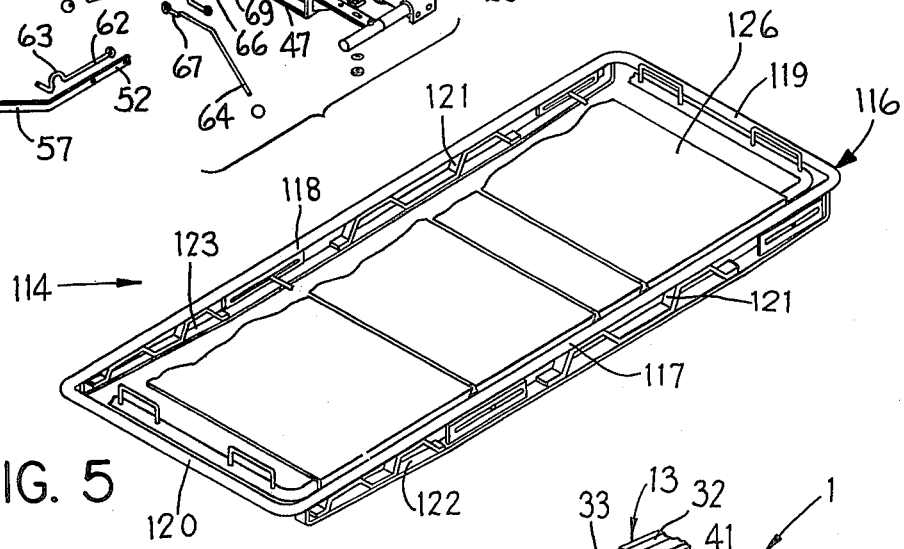
FIG. 5 is an oblique view of a patient supporting litter adapted for use within the concept of this invention.
Figure 6:
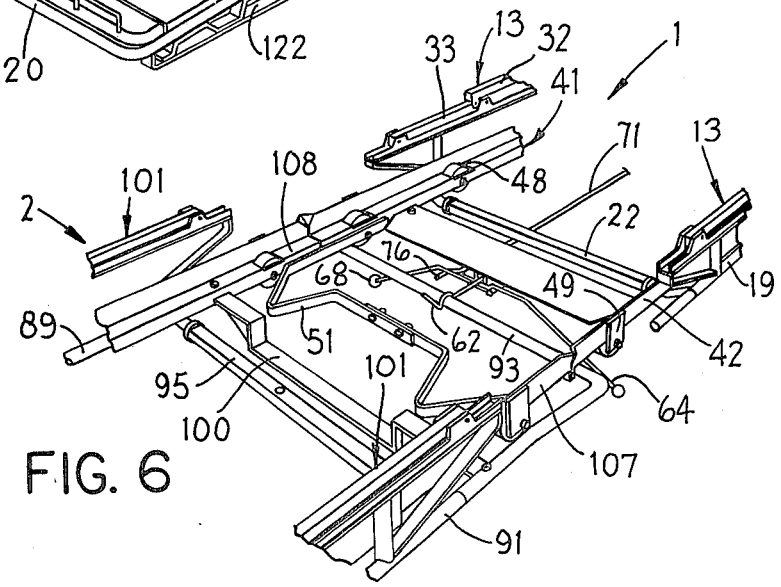
FIG. 6 is an oblique fragmentary view of the stretcher and bed connected for effecting transfer of the patient supporting litter from one thereof to the other.

The litter-supporting frame 12, as shown in FIGS. 3 and 4, includes a U-shaped subframe 16, here of tubular material, formed by side members 18 and 19 joined together by an end member 21. A pair of cross connectors 22 and 23 extend between the side members 18 and 19, which members are also joined by cross beams 24 and 26. Barrier support beams 27 and 28 are arranged above and parallel with the side members 19 and 18 and are supported in spaced relation with respect thereto by a series of suitable posts 29 and 30. A collapsible side barrier 13 is mounted on and extends upwardly from each barrier support beam 27 and 28. Each side barrier 13 includes a horizontal top rail 32 connected to the underlying support beam 27 or 28 by a plurality of vertical posts 33 which are pivoted at the upper and lower ends thereof, whereby the barrier 13 can be collapsed as shown in FIG. 6.

Litter support rails 41 and 42 are supported on the cross beams 24 and 26 and are preferably fixed thereto, as by bolts 43 (FIG. 3). Rails 41 and 42 each comprise a generally Z-shaped member having a middle flange 44 together with lower and upper flanges 46 and 47 to provide stiffening to said middle flange. A series of rollers 48 extend through appropriate openings in the middle flange 44 to receive and facilitate longitudinal motion of a litter, to be further described hereinafter. The rollers 48 are mounted in any convenient manner, such as by pivot pins 45 which extend between the lower flange 46 and tabs 49 (FIG. 4) extending downwardly from the upper flange 47.

A pilot member 51, which is of a W-shaped configuration as shown in FIGS. 3 and 4, is secured to and projects outwardly from the rails 41 and 42 at the open end of the subframe 16. Pilot member 51 includes side members 52 and 53 which lie alongside the inner surfaces of the bottom flanges 46, being bolted thereto. The slanting portions 56 and 57 of said pilot member assist in guiding the stretcher 1 into appropriate interfitting relationship with the movable bed 2. A latch mounting clevis 61 is fixed to a midportion of the cross beam 26 and pivotally supports an elongated hooklike latch 62. Said latch 62 has an offset portion 63 for suitably engaging, in a manner hereinafter described, a cross beam 93 of the bed 2.

There is further provided convenient means for releasing the latch 62. In this instance, same can be accomplished by a first release handle 64 which is pivoted at 66 to a portion of the mounting clevis 61, such that when the free end of said handle 64 is lifted, an intermediate handle portion 67 contacts the latch 62 to lift same out of engagement with cross beam 93. A second release handle 68 is pivoted at 69, in a somewhat mirror image relationship to said first release handle 64, for release of the latch 62 from the other side of the stretcher.

In addition, an elongated release rod 71 is mounted for rotation at 72 on the cross member 24 and at 73 on the cross member 26. One end 74 is offset to effect rotation of said rod from the end of the stretcher remote from the pilot 51, and the other end is provided with crank means 76 which will engage the latch 62 and release it upon suitable rotation of said rod. Thus, the latch 62 may be released from the remote end of the stretcher.

Figure 2:
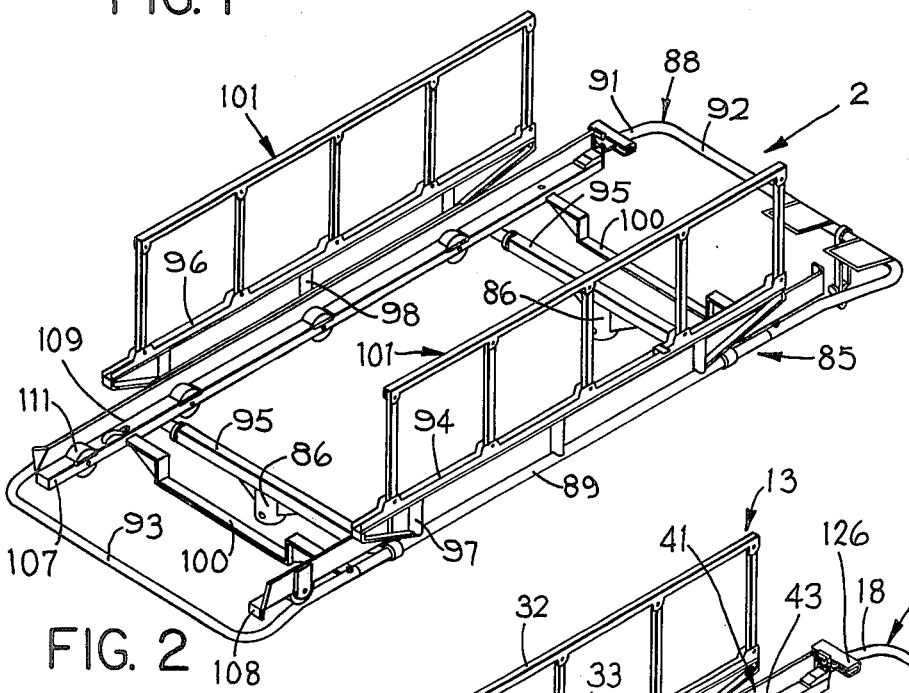
FIG. 2 is an oblique view of the litter supporting frame of one form of known wheel supportable stretcher, as modified to incorporate the present invention.

Referring now to FIG. 2, the second carrier, here the surgical bed 2, has a construction broadly similar to a general transport stretcher manufactured and sold under the trademark "TRANSCARE" by Stryker Corporation of Kalamazoo, Michigan, with certain modifications and refinements appropriate to the present invention as described hereinafter. Broadly speaking, said bed is provided with a base structure of any convenient type which, in this instance, includes an I-shaped member 81 supported by four swivel casters 82. A pair of posts 83 and 84 project upwardly from the member 81 and are engaged at their upper ends by suitable receptacles 86 (FIG. 2), as further described hereinafter.

In this embodiment, the bed includes a patient supporting frame 85 which comprises a substantially rectangular subframe 88 having side members 89 and 91 and end members 92 and 93. Barrier support beams 94 and 96 are supported on the side members 89 and 91 respectively by any convenient means, such as posts 97 and 98. A collapsible side barrier 101 is mounted on and extends upwardly from each of the barrier support beams 94 and 96. Barriers 101 are pivotally collapsible in the same manner as the barriers 13 of the stretcher, as described above.

Cross connectors 95, each supported on a post receptacle 86, extend between and support the side members 89 and 91 in the same manner as the cross connectors 22 and 23 of the stretcher. Further, cross beams 100 extend between and are affixed to the side members 89 and 91 and correspond to the cross beams 24 and 26 of the stretcher.

Litter supporting rails 107 and 108 are mounted on the cross beams 100, and are fixed thereto in any convenient manner, such as by bolts 109. The rails 107 and 108 are identical to the rails 41 and 42, and similarly have rollers 111 affixed thereto.

As best shown in FIG. 6, the parts of the bed 2 and stretcher 1 are so dimensioned that the respective rails 107 and 108 of the bed are longitudinally alignable with the rails 41 and 42 of the stretcher. When so aligned, the pilot 51 will snugly engage the mutually facing surfaces of said rails 107 and 108 to hold the stretcher and bed in secure alignment with one another. It will be further observed that said end 93 of the bed subframe is bent sufficiently downwardly so that said end may pass under the pilot 51 as a stretcher and a bed are brought together with their respective rails properly aligned. The latch 62 will then automatically engage the end member 93. It will be evident from the drawings that the end member 92 is also depressed similarly to end member 93 whereby with appropriate and obvious modification of the latching means, the pilot 51 of the first carrier may also engage the end member 92, or either end of the second carrier, as desired.

Turning now to the patient-carrying litter, same is of generally conventional construction but suitably modified to incorporate the invention and for cooperation with the apparatus above described. The litter 114 comprises in this embodiment a rectangular frame 116 having side rails 117 and 118 and end rails 119 and 120. Runners 122 and 123 are below and parallel with the side rails 117 and 118 and are rigidly fixed thereto by any convenient means, such as by truss members 121. Said side rails 117 and 118 are preferably spaced laterally the same as the runners 122 and 123 and said runners are spaced for riding on the rollers of both the bed and the stretcher, namely the rollers 48 and the rollers 111, respectively. Any convenient type of patient support means 126 is supported in any appropriate manner on and by the frame 116. Same may be of any convenient and known type including conventional gatching and/or Fowler position means or other type of support means which enables a patient's back and/or legs to be raised to greater or lesser extents as desired.

OPERATION

Assuming that the stretcher 2 is being used, for example, in the emergency receiving room of a hospital, a patient placed upon the litter 114 is loaded either endwise onto the stretcher or, with one of the barriers 13 in a collapsed condition, the patient may be loaded laterally thereon if preferred. In either case, the runners 122 and 123 of the patient-supporting litter 114 are supported on and by the rollers 48 of the stretcher and safety-latched thereto by any appropriate means, such as the litter latch indicated generally at 126. The stretcher is then wheeled to an appropriate location, such as the entry into a sterile zone, and its lift means 6 and 7 operated, if necessary, to place the litter supporting rails 41 and 42 at the same elevation as the rails 107 and 108 of the bed. When such equality in height is achieved, the stretcher may be then advanced so that its pilot member 51 is received between the rails 107 and 108 of the bed, guiding and aligning said litter supporting rails into exact end-to-end relationship with respect to each other, as shown in FIG. 6. The latch 62 automatically engages the end member 93 of the bed when the proper interlocked position is achieved, namely when the litter supporting rails of the respective units are in substantially end-to-end contact with each other. The safety latch 126 is then released and the litter 114 is moved longitudinally from the stretcher 2 to the bed 1. The latch 62 is then released by lifting any one of the handles 64, 68 or 74 (FIG. 4), and the stretcher withdrawn from engagement with the bed.

Accordingly, the litter and patient can be safely and easily moved from a contaminated zone into a sterile zone (such as an operating room) with a minimum risk of contaminating the sterile zone.

While the foregoing for illustrative purposes has assumed, as already above indicated, that the first carrier 1 is a wheel supported stretcher and the second carrier 2 is a surgical bed, it will be recognized that these specific components may be reversed or further that both of same may be stretchers and/or both of same may be surgical beds. Further, it has been assumed for illustrative purposes that the wheel supported stretcher 1 is vertically adjustable in a conventional manner and that the surgical bed 2 is of fixed height. It will be equally evident that both such carriers may be of vertically adjustable construction if desired or both of them may be of fixed height provided only in the latter case that they are at least substantially of the same height.

Thus, although a particular preferred embodiment of the invention has been disclosed in detail for illustrative purposes, it will be recognized that the foregoing suggested and other variations or modifications of the disclosed apparatus, including the rearrangement of parts, lie within the scope of the present invention.

The embodiments of the invention in which an exclusive property or privilege is claimed are defined as follows:

1. In combination, a litter means for supporting a patient, and a pair of wheel-supported carriers each having means for supporting said litter means in a predetermined plane and also having means for facilitating the transfer of said litter means between said carriers when said carriers are positioned adjacent each other in an end-to-end relationship, the improvement comprising:

cooperating means provided on said carriers (1) for automatically guiding said carriers into longitudinal alignment with respect to each other as said carriers are relatively moved toward one another into said adjacent end-to-end relationship and (2) for holding said carriers rigidly against movement with respect to each other in a transverse direction when said carriers are in said adjacent end-to-end relationship, whereby transfer of said litter means between said carriers may be effected efficiently and safely;

said cooperating means including guide means rigidly provided on at least one of said carriers, and receiving means rigidly provided on the other of said carriers and snugly slidably engageable with said guide means as said carriers are relatively moved toward one another into said adjacent end-to-end relationship.

2. The combination of claim 1, wherein said guide means comprises at least one member projecting outwardly of said adjacent end of said one carrier, and said receiving means include socketlike means positioned on said other carrier at the adjacent end thereof for receiving said projecting member therein when said carriers are pushed into said adjacent end-to-end relationship.

3. The combination of claim 1, wherein said cooperating means permit said carriers to be moved into said adjacent end-to-end relationship only in a direction which is approximately perpendicular to said adjacent ends.

4. The combination of claim 1, wherein said guide means comprise means snugly engaging said receiving means for inhibiting movement of said carriers away from each other and out of said adjacent relationship.

5. The combination of claim 1, wherein said guide means comprise at least one pilot member secured to said one carrier, said pilot member having alignment means positioned for engaging said receiving means as said carriers are pushed into said adjacent end-to-end relationship to effect said automatic alignment of said carriers with respect to each other.

6. The combination of claim 5, wherein said alignment means includes at least one slanting surface for slidingly engaging a surface of said receiving means.

7. The combination of claim 5, wherein said pilot member also includes means positioned for engaging said receiving means when said carriers are in said adjacent relationship to effect said holding of said carriers against transverse movement with respect to each other.

8. In combination, a litter means for supporting a patient, and a pair of wheel-supported carriers each having means for supporting said litter means in a predetermined plane and also having means for facilitating the transfer of said litter means between said carriers when said carriers are positioned adjacent each other in an end-to-end relationship, the improvement comprising:

cooperating means provided on said carriers for automatically guiding said carriers into longitudinal alignment with respect to each other as said carriers are pushed into said adjacent end-to-end relationship, said cooperating means also holding said carriers rigidly against movement with respect to each other in a transverse direction when said carriers are in said adjacent relationship, whereby transfer of said litter means between said carriers may be effected efficiently and safely;

said cooperating means including guide means provided on at least one of said carriers, and receiving means provided on the other of said carriers and cooperable with said guide means; and latch means provided on said carriers for releasably connecting said carriers in said adjacent end-to-end relationship.

9. The combination of claim 8, wherein said latch means includes a latch member mounted on said one carrier and disposed for latching engagement with an element associated with the other carrier when said carriers are disposed in said adjacent end-to-end relationship, whereby said latch means prevent relative separation between said carriers, and manually-actuated release means associated with said one carrier for disengaging said latch member from said other carrier.

10. The combination of claim 8, wherein each of said carriers includes a pair of substantially parallel elongated support rails extending horizontally of the respective carrier throughout a substantial portion of the length thereof, said pair of rails being disposed adjacent the opposite sides of the respective carrier, the pair of rails on one carrier being positioned adjacent and substantially aligned with the pair of rails on the other carrier when said carriers are disposed in said adjacent end-to-end relationship, said guide means including a pilot member secured to said one carrier and projecting outwardly beyond the rails associated therewith, and said receiving means being provided by a recess which is located between the pair of rails associated with said other carrier, whereby said pilot member is snugly and slidably received within said recess to effect and maintain alignment between said pairs of rails.

11. The combination of claim 8, wherein said latch means includes means for automatically effecting said releasable connection as said carriers are pushed into said adjacent relationship.

12. The combination of claim 11, wherein said latch means comprise an elongate latch member having one end pivotally mounted to one of said carriers, an angled portion at the other end thereof, and an offset portion between said ends and adjacent said angled portion, said angled portion engaging a structural member of the other of said carriers as said carriers are moved into said adjacent relationship to effect a pivotal displacement and return of said latch member, thereby facilitating engagement of said offset portion of said latch member with said structural member of said other carrier.

13. The combination of claim 8, including release means for disengaging said latch means, said release means having at least one release handle located at a point on one of said carriers remote from said latch means.

14. The combination of claim 13, wherein said guide means and said latch means are located at one end of said one carrier, and wherein said release means includes one said release handle at the opposite end of said carrier and one said release handle at each side of said carrier.

15. In combination, a litter means for supporting a patient, and a pair of wheel-supported carriers each having two mutually perpendicular pairs of opposed perimetrical edges, each said carrier having means for supporting said litter means in a predetermined plane and means for facilitating the transfer of said litter means between said carriers when said carriers are positioned adjacent each other in an edge-to-edge relationship, the improvement comprising:

cooperating means provided on said carriers (1) for automatically guiding the centerlines of said carriers which are perpendicular to the respective said adjacent edges into mutual linear alignment as said carriers are relatively pushed into said adjacent edge-to-edge relationship and (2) for holding said carriers rigidly against movement with respect to each other in a direction substantially parallel to said adjacent edges;

said cooperating means including projecting guide means provided on one of the carriers in the vicinity of the adjacent edge thereof, and receiving means provided on the other of said carriers in the vicinity of the adjacent edge thereof, said receiving means defining a recess for snugly slidably receiving therein said guide means; and releasable latch means provided on said carriers for automatically connecting said carriers together when they are relatively pushed together in said edge-to-edge relationship to prevent separation of said carriers, whereby transfer of said litter means between said carriers may be effected efficiently and safely.

16. In combination, a litter means for supporting a patient, and a pair of wheel-supported carriers each having means for supporting said litter means in a predetermined plane and also having means for facilitating the transfer of said litter means between said carriers when said carriers are positioned adjacent each other in an end-to-end relationship, the improvement comprising:

cooperating means provided on said carriers for automatically guiding said carriers into longitudinal alignment with respect to each other as said carriers are pushed into said adjacent end-to-end relationship, said cooperating means also holding said carriers rigidly against movement with respect to each other in a transverse direction when said carriers are in said adjacent relationship, whereby transfer of said litter means between said carriers may be effected efficiently and safely;

said cooperating means including guide means provided on at least one of said carriers, and receiving means provided on the other of said carriers and cooperable with said guide means;

said guide means comprising at least one pilot member secured to said one carrier, said pilot member having alignment means positioned for engaging said receiving means as said carriers are pushed into said adjacent end-to-end relationship to effect said automatic alignment of said carriers with respect to each other, said pilot member also including means positioned for engaging said receiving means when said carriers are in said adjacent relationship to effect said holding of said carriers against transverse movement with respect to each other;

said pilot member being substantially W-shaped and having outer legs each having a straight portion comprising said holding means and a slanting portion comprising said alignment means, said straight portions each extending horizontally outwardly from said one carrier substantially perpendicular to said adjacent ends, said slanting portions extending further horizontally outwardly beyond said straight portions and being angled toward each other;

said receiving means including two elongate structural members of said other carrier, each oriented substantially perpendicular to said adjacent ends, and said slanting portions slidingly engaging said structural members as said carriers are pushed together for longitudinally aligning said carriers and guiding said pilot member into reception between said two structural members, whereby said straight portions engage said structural members to effect said holding of said carriers against transverse movement with respect to each other.

* * * * *